US007354258B2

(12) United States Patent
Jäger

(10) Patent No.: US 7,354,258 B2
(45) Date of Patent: Apr. 8, 2008

(54) STATOR FOR AN ECCENTRIC SINGLE-ROTOR SCREW PUMP AND METHOD FOR ITS PRODUCTION

(75) Inventor: Sebastian Jäger, Hannover (DE)

(73) Assignee: Artemis Kautschuk-und Kunstoff-Technik GmbH, Hannover (DE)

( * ) Notice: Subject to any disclaimer, the term of this patent is extended or adjusted under 35 U.S.C. 154(b) by 0 days.

(21) Appl. No.: 11/472,541

(22) Filed: Jun. 22, 2006

(65) Prior Publication Data

US 2007/0020133 A1 Jan. 25, 2007

(30) Foreign Application Priority Data

Jun. 22, 2005 (DE) ..... 10 2005 028 818

(51) Int. Cl.
*F04C 18/00* (2006.01)
*F03C 2/00* (2006.01)

(52) U.S. Cl. ..... 418/48; 418/1; 418/153; 418/179; 29/888.023

(58) Field of Classification Search ..... 418/1, 418/48, 152, 153, 178, 179; 29/888.023
See application file for complete search history.

(56) References Cited

U.S. PATENT DOCUMENTS 3,499,389 A * 3/1970 Seeberger et al. ..... 418/48
3,912,426 A * 10/1975 Tschirky ..... 418/48
5,221,197 A * 6/1993 Kochnev et al. ..... 418/48
5,807,087 A * 9/1998 Brandt et al. ..... 418/48
6,872,061 B2 * 3/2005 Lemay et al. ..... 418/48

FOREIGN PATENT DOCUMENTS

| | | |
|---|---|---|
| DE | 1 985 861 | 5/1968 |
| DE | 279 043 A1 | 5/1990 |
| DE | 195 34 774 A1 | 3/1997 |
| DE | 298 22 365 U1 | 5/1999 |
| DE | 200 10 494 U1 | 10/2000 |
| DE | 198 55 898 C2 | 9/2001 |
| DE | 198 04 260 C2 | 4/2003 |
| DE | 102 41 753 C1 | 11/2003 |
| DE | 199 50 257 A1 | 4/2004 |
| DE | 697 29 108 T2 | 9/2004 |

OTHER PUBLICATIONS

German Office Action dated Nov. 30, 2005 in German Application No. 10 2005 028 818.9-15, filed Jun. 22, 2005 (2 pages).

* cited by examiner

*Primary Examiner*—Theresa Trieu
(74) *Attorney, Agent, or Firm*—Shlesinger Arkwright & Garvey LLP

(57) ABSTRACT

Stator for an eccentric single-rotor screw pump has a casing made of steel or the like and a helical elastomer lining. Stator and a method for its production are described which can also be made with larger lengths at low production costs. Stator is composed of at least two stator segments that are axially arranged in a line, whereby the stator segments are connected to one another at their abutment so as to be pressure-tight by a tube of a polymer material that is pulled onto the casing and overlaps the abutments and by a metal ring radially pressed onto it.

11 Claims, 2 Drawing Sheets

STATOR FOR AN ECCENTRIC SINGLE-ROTOR SCREW PUMP AND METHOD FOR ITS PRODUCTION

CROSS-REFERENCE TO RELATED APPLICATIONS

This application claims the priority of German application no. 10 2005 028 818.9, filed 22 Jun. 2005, and which is incorporated herein by reference.

FIELD OF THE INVENTION

The present invention relates to a stator for an eccentric single-rotor screw pump according to the preamble of claim 1.

BACKGROUND OF THE INVENTION

Pumps of this type are known, for example, from DE 198 04 260 C2, DE 200 10 494 U1, DE 298 22 365 U1, DE 199 50 257 A1, DE 697 29 108 T2, DE 102 41 753 C1, DE 195 34 774 A, DE 198 55 898 C2 and DD 279 043 A1. They are used to convey viscous and aggressive media which may also contain solid particles. Eccentric single-rotor screw pumps have a very broad range of applications which extends from the food industry to the building industry and are distinguished by a very simple construction with few moving parts.

Aside from the drive and connecting parts, they essentially consist of a stator and a rotor. The stator has a casing which is lined with an elastomer while leaving an axially continuous, central, spiral cavity. The cavity serves to accommodate the rotor which is also coiled, the helix of the stator being a pitch larger than that of the rotor. When the rotor is actuated, progressive chambers, in which the material to be conveyed is conveyed from the intake side to the pressure side, form between its outer contour and the inner contour of the elastomer lining.

The casing of the stator can be smooth-walled, as found e.g. in DE 195 34 774 A1, or also follow the winding of the elastomer lining, as disclosed e.g. in DE 198 04 260 C2. The latter design has the advantage that the elastomer lining has a uniform wall thickness, as a result of which the pressing with the rotor seen over the length of the stator becomes uniform. However, this advantage is obtained at a higher production cost for the stator casing.

A stator for an eccentric single-rotor screw pump is known from DE 102 41 753 C1 which is composed of several segments that extend in axial direction. The longitudinal edges of these segments are thereby formed in such a way that they engage in a form-locking manner, e.g. in the manner of a groove and tongue joint, and are movable against one another. By combining these segments, the diameter of the stator can be varied, as a result of which additional construction and tool costs are not incurred for every new pump size or group of pump sizes.

The pressure that can be obtained with an eccentric single-rotor screw pump on the pressure side is dependent on the number of stages and with that also on the length of the stator. In principle, the stators can be produced in one piece in all required lengths. However, the tool and production costs also increase with increasing length of the stator since larger machines must generally be used. As a result, it has also already been proposed (DE 19 85 861 U1) to arrange stators in a row in that they adjoin one another directly, i.e. without a gap, and are held together with connecting rods. A sealing ring is pushed over each joint abutment, said sealing ring having peripherally extending grooves on both sides of the joint abutment, said grooves serving to accommodate seals and centering both adjoining stators in the middle. This solution has the disadvantage that the seal provided between two stators does not withstand higher pressures.

OBJECTS AND SUMMARY OF THE INVENTION

The object of the present invention is to provide a stator for an eccentric single-rotor screw pump of the generic type and a method for its production, in which the connection between two stator segments is also tight at pressures above 80 bar.

According to the invention, this object is solved with a stator which has the features of claim 1 or by a method with the features of claim 7.

Thus, according to the invention, two adjoining stator segments are connected together in a pressure-tight manner by a metal ring radially pressed onto it. Surprisingly, it was shown that this connection is also tight at pressures above 80 bar.

The stator segments can be parts which are specially made for assembling longer stators or also for stators that are, in any case, already found in the production program, whereby the stator segments can have the same or different lengths. In both cases, construction, tool and production costs are saved in comparison to longer stators produced as one piece since no additional tools are required and making the connection between the stator segments is comparatively more cost efficient. This connection technology can be used both for stators with a smooth cylindrical casing and for stators with a helical casing.

The tightness of the connection can be further improved by peripherally extending grooves and/or strips formed on the casing and/or metal ring in the overlapping area.

In an advantageous embodiment of the invention, a flexible tube consisting of an elastomer, in particular rubber, can be arranged between the casing and the metal ring, since a good sealing effect can be obtained with this material. However, instead of a flexible tube of this type, a liquid sealing material may also be applied between the casing and the metal ring.

The solution according to the invention enables, in an especially advantageous manner, the production of a stator which has a smooth cylindrical casing over one or more sections of its length and a helical casing over one or more other sections of its length by combining stator segments of a corresponding design with one another. The same applies to a combination of stator segments having a different geometry, whereby combinations of stator segments with both different geometry and different casing design are also possible. According to the invention, the stator of the invention can be advantageously produced in that the at least two stator segments are first arranged adjacent to one another axially with an essentially continuous transition of their windings.

A metal ring is then pushed over the joint abutment which is then radially compressed onto the casing. An axial compression of the stator segments can promote the sealing integrity of the connection, however, it is not absolutely necessary.

Further advantageous embodiments of the method can be found in the subclaims.

The invention will be described in greater detail in the following with reference to two examples of embodiments. The attached drawings show:

DETAILED DESCRIPTION OF THE INVENTION

Figure 1:
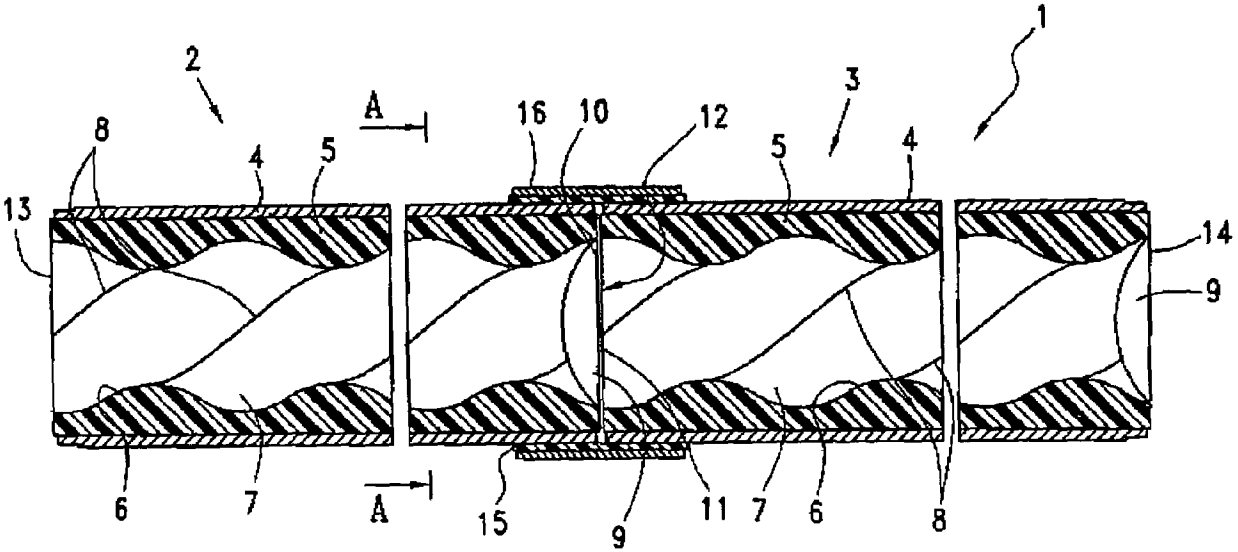
FIG. 1 a longitudinal section through a stator for an eccentric single-rotor screw pump which consists of two individual stators according to a first embodiment of the invention, FIG. 2 a section A-A of FIG. 1, and FIG. 3 a representation according to FIG. 1 in a further embodiment of the invention.
Figure 2:
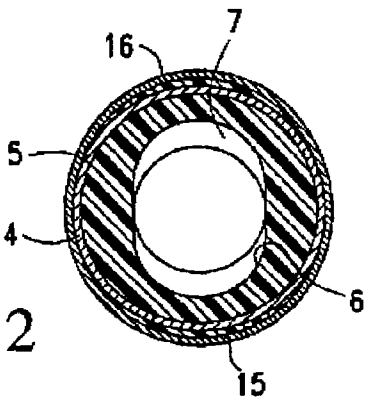

The stator 1 shown in FIG. 1 for an eccentric single-rotor screw pump consists of two segments 2 and 3 which, in the embodiment, are independently usable and marketable stators. These can be stators which can be manufactured in large quantities and thus very cost efficiently. Of course, it is also possible to produce just segments for assembly to form a longer stator.

The segments 2 and 3 are constructed in the same way. They have a casing 4 in the form of a smooth cylindrical pipe made of steel with a constant wall thickness. The casing 4 encloses a lining 5 of rubber or a rubber-like plastic. The lining 5 adheres firmly to the inner wall of the casing 4 by vulcanizing it onto said inner wall.

The inner side 6 of the lining 5 defines an axially continuous cavity 7 and has the form of a double helix 8. In this way, the cavity 7 represents to a certain degree a double-threaded nut with a large pitch. The cavity 7 accommodates a rotor (not shown) which is simply coiled. The inlet 9 into the cavity 7 is made in the form of a calotte.

To produce the stator 1, the segments 2 and 3 are arranged behind one another, aligned axially to one another, so that their adjacent front ends 10 and 11 adjoin at a joint abutment 12. Furthermore, the segments 2 and 3 are aligned by turning against one another in such a way that the double helix 8 continues essentially continuously at the abutment 12 in the respectively other segment 2 or 3. The discontinuity in the cavity 7 formed by the inlet 9 of the segment 2 does not affect the function of the pump or only affects it negligibly. In addition, the segments 2 and 3 aligned in this way can, but do not have to, be pressed together at the abutment 12 by axial pressure on their outer front ends 13 or 14.

A rubber tube 15 is first pulled onto the aligned segments 2 and 3 in such a way that it overlaps their abutment 12. The diameter of the tube 15 is selected in such a way that it already lies on the casings 4 of the segments 2 and 3 with tension. After the tube 15 has been positioned in this way, a metal ring 16 is pushed onto the segments 2 and 3. The inside diameter of the metal ring 16 is slightly larger than the outside diameter of the tube 15 pulled onto the segments 2 and 3. Therefore, the metal ring 16 can be pushed over the tube 15, so that it also overlaps the abutment 12 on both sides. The metal ring 16 is now pressed on with a radial upsetting press or another suitable machine onto the casings 4 of the segments 2 and 3 with the tube 15 in between, so that a secure and, above all, pressure-tight connection of the segments 2 and 3 is produced.

Figure 3:
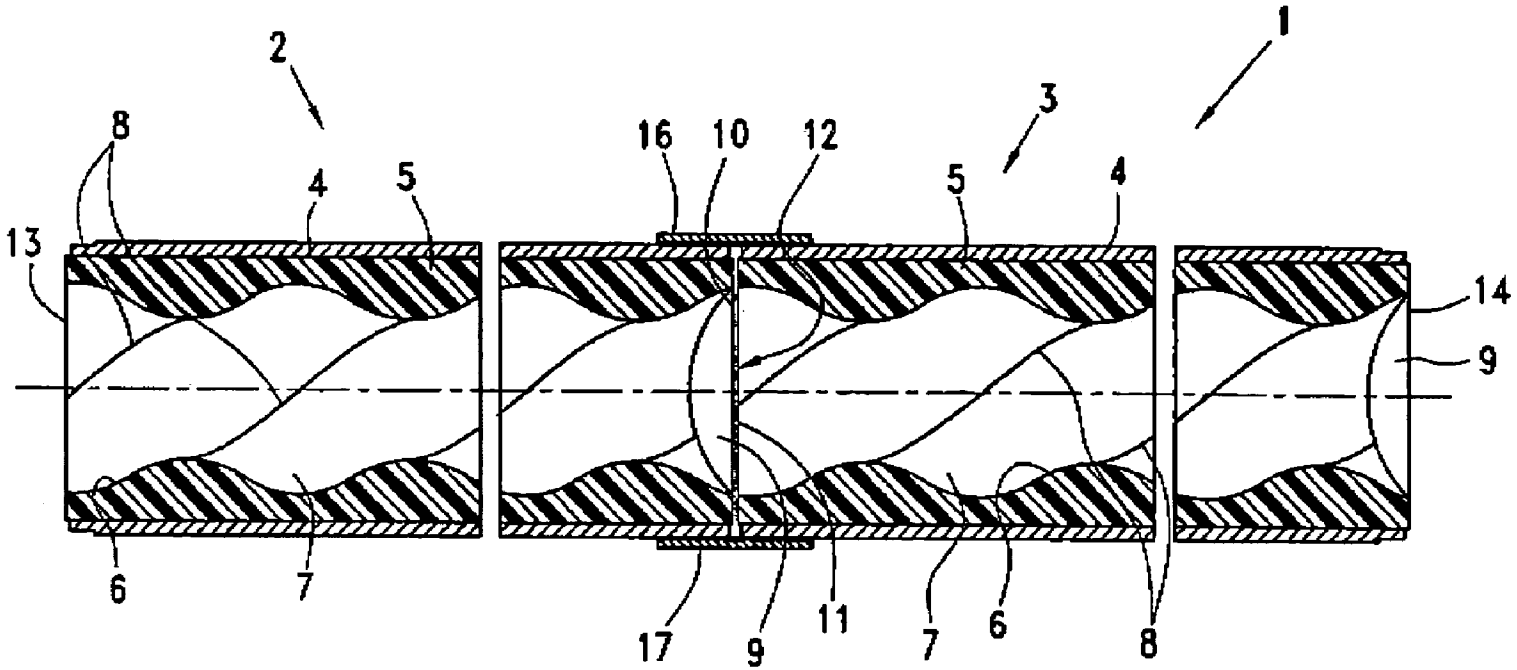

The embodiment shown in FIG. 3 only differs from the preceding in that the metal ring 16 is pressed directly onto the casing 4. In addition, a liquid sealing material 17 may optionally be applied between the casing 4 and the metal ring 16 to further increase the tightness.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. A stator for an eccentric single-rotor screw pump, the stator comprising:

a) a steel casing;

b) a helical elastomer lining, the helical elastomer lining including at least two stator segments, the at least two stator segments each having abutments, and the at least two stator segments being axially arranged relative to one another in a line, and adjoining at a joint abutment; and c) the stator segments being connected to one another in a pressure-tight manner at their respective abutments at the joint abutment by a metal ring, the metal ring being pulled onto the steel casing, overlapping the abutments at the joint abutment, and being radially pressed onto the metal casing.

2. The stator according to claim 1, wherein:

a) one of the steel casing and the metal ring includes one of peripherally extending grooves and strips in an overlapping area where the metal ring overlaps the abutments at the joint abutment.

3. The stator according to claim 2, wherein:

a) a liquid sealing material is applied between the steel casing and the metal ring.

4. The stator according to claim 1, wherein:

a) a flexible tube, which is made of an elastomer, is pulled onto the steel casing, and is provided between the steel casing and the metal ring.

5. The stator according to claim 4, wherein:

a) the steel casing is one of smooth-walled and helical.

6. A method for producing a stator according to claim 1, wherein:

a) the at least two stator segments are axially aligned and arranged axially adjacent to one another with an essentially continuous transition of alternating windings;

b) the metal ring is first pulled over the respective abutments at the joint abutment of the at least two stator segments; and c) finally, the metal ring is then pressed radially onto the metal casing of the at least two stator segments.

7. The method according to claim 6, wherein:

a) the at least two stator segments are axially pressed together when the metal ring is pulled on and the metal ring is radially pressed on.

8. The method according to claim 7, wherein:

a) a flexible tube made of a polymer material is pulled over the respective abutments at the joint abutment before the metal ring is pulled on and the metal ring is compressed radially with the thus underlying flexible tube onto the steel casing of the at least two stator segments.

9. The method according to claim 6, wherein:

a) a liquid sealing material is applied between the steel casing and the metal ring prior to the metal ring being pressed on.

10. The stator according to claim 1, wherein:

a) a liquid sealing material is applied between the steel casing and the metal ring.

11. The stator according to claim 1, wherein:

a) the at least two stator segments include a respective smooth-walled and a helical casing, and the at least two stator segments including the respective smooth-walled and the helical casing are combined with one another.

* * * * *